United States Patent [19]

Schröder et al.

[11] Patent Number: 4,967,512

[45] Date of Patent: Nov. 6, 1990

[54] ARRANGEMENT FOR CONTROLLING THE CLOSING SEQUENCE OF TWO WINGS OF A DOOR, WINDOW OR THE LIKE

[75] Inventors: Gerhard Schröder, Tiefenbronn; Dieter Mauckner, Leonberg, both of Fed. Rep. of Germany

[73] Assignee: Gretsch-Unitas GmbH, Ditzingen, Fed. Rep. of Germany

[21] Appl. No.: 395,318

[22] Filed: Aug. 17, 1989

[30] Foreign Application Priority Data

Aug. 17, 1988 [DE] Fed. Rep. of Germany ..... 8810389

[51] Int. Cl.[5] ..... E05C 7/05

[52] U.S. Cl. ..... 49/367; 16/82

[58] Field of Search ..... 49/367, 368, 369, 366; 16/82; 292/333

[56] References Cited

U.S. PATENT DOCUMENTS 4,583,324 4/1986 Storz et al. ..... 49/367

*Primary Examiner*—Philip C. Kannan

*Attorney, Agent, or Firm*—Toren, McGeady and Associates

[57] ABSTRACT

An arrangement for controlling the closing sequence of two wings of windows, doors, and the like, especially smoke or fire protection doors, which are closable by means of a door-closing device each. The two wings are a moving wing to be opened first and a resting wing to be opened subsequently, so that projecting edges of the doors which face each other come into contact with each other in the correct sequence. A control device is actuated primarily by the slide rollers of the door-closing device of the resting wing when the resting wing is opened. With the use of a control lever and a sliding member displaced by the control lever toward the axis of rotation of the resting lever, a locking member is pivoted into the return end region of the guide roller of the door-closing device of the moving wing. This locking member locks the final closing movement of the moving wing until the resting wing has been closed. The sliding member is maintained with the aid of a locking device in a swung-out position until the resting wing has again been closed. The guide roller of the door-closing device of the resting wing releases the locking device.

41 Claims, 6 Drawing Sheets

ARRANGEMENT FOR CONTROLLING THE CLOSING SEQUENCE OF TWO WINGS OF A DOOR, WINDOW OR THE LIKE

BACKGROUND OF THE INVENTION

1. Field of the Invention

The present invention relates to a control of the closing sequence of two wings or leaves of windows, doors or the like which are closeable by means of a door-closing device each.

2. Description of the Related Art

The two wings or leaves of doors, windows or the like mentioned above are a moving wing to be opened first and a resting wing to be opened subsequently. Each door closing device attached to a wing is equipped with a guide roller or the like which is mounted on a pivotable sliding arm and is horizontally guided on a fixed frame. The two wings are rotatably hinged to opposite vertical sides of a frame. If the wings are equipped as usual with projecting edges, one of the wings must always be closed before the other, so that the projecting edges can engage in each other and the second wing can be closed without being obstructed by the projecting edge of the first wing.

In doors having two wings, one of the doors is usually kept closed and, therefore, is called the resting wing, while the other door is continuously opened and closed or may also be held in an open position for a period of time and, therefore, is called the moving wing. Both doors are provided with a door closing device of known construction which, unless the doors are locked, return the doors after they are released into the closed position.

If a locking device is provided, this locking device must be manually or automatically released prior to closing, so that the door closing device can carry out its closing function. When the doors are smoke and fire protection doors, such a locking device can be automatically released in the case of fire by means of an appropriate monitoring unit. It must be ensured particularly in this case that the closing sequence of the two doors is absolutely maintained because the doors could otherwise not be completely closed. One of the doors, particularly the moving wing, can be closed up to a position which is relatively close to the closed position, however, the door must then be maintained in this position until the other wing, i.e., the resting wing, has assumed its closed position.

Hereinbelow, it is assumed that it is always the resting wing which must be closed before the moving wing.

Arrangements for controlling the closing sequence of two doors which are each closable by means of a door-closing device are already known. A door-closing device is understood to be a conventional device which always acts on the wing in the swinging closing direction and whose force becomes effective when no other forces act on the open or partially open wing in opening direction and when no holding forces act on the wing and when the wing is also not locked. Such door-closing devices may be mounted in the upper as well as the lower end of the door.

An arrangement for controlling the closing sequence of wings, also called closing sequence regulator, must not only safely close the doors in a predetermined sequence, but must also meet certain aesthetic requirements. In addition, the arrangement should be as much as possible protected against damage, particularly against intentional damage. Furthermore, the closing sequence regulator must operate as safely as possible, particularly when the doors are fire or smoke protection doors.

For example, a closing sequence regulator has been known in which a hydraulic valve in the bypass line of the door-closing device is controlled through the resting wing. However, such devices are frequently not safe enough in their operation because leaks in the hydraulic system cannot be avoided absolutely safely and because of the sensitivity of the control elements in the case of fire. It is, therefore, the primary object of the present invention to provide a closing sequence regulator in which the above-described disadvantages are avoided and to further develop the above-described arrangement in such a way that hydraulic units are avoided and, consequently, the operational safety is increased. In addition, the arrangement should be robust, inexpensive to manufacture and easy to assemble.

SUMMARY OF THE INVENTION

In the arrangement for controlling the closing sequence of two wings of windows, door or the like which are each closable by means of a door-closing device, each door-closing device is equipped with a guide roller or the like which is mounted on a pivotable sliding arm and is guided on a fixed frame, or each door-closing device has an element, particularly a hydraulic piston, which is displaceable by the swinging movement of the door. The improvement provided by the present invention resides in the following features A locking member which is movable by the opening movement of the resting wing into the return end region of the moving wing guide roller or by a roller or the like of the moving wing which is fixedly connected to the slidable element. The sliding member can be actuated parallel to the wing plane by means of a sliding member which is adjustable horizontally and parallel to the plane of the fixed frame. The sliding member is provided with or connected to a locking element of a locking device. The locking element is slidable against the force of a restoring spring by the opening movement of the resting wing guide roller or the roller or the like of the resting wing. A spring-biased control lever supported on the sliding member is arranged between the locking element and the resting wing guide roller or the roller or the like of the resting wing. The control lever projects into the initial displacement region of the resting wing guide roller or the roller or the like of the resting wing and the pivoting movement of the control lever is released only in the locking position of the locking member. A spring-biased locking piece of the locking device is held in an ineffective position in the initial position of resting wing guide roller or the roller or the like of the resting wing and the locking piece can be disengaged by the return end movement of the roller.

The first embodiment of the arrangement according to the present invention is used in connection with door-closing devices which have a pivotable sliding arm and which are connected to the door in the case of a door-closing device mounted at the top of the door. The sliding arm of the door-closing device is moved along the fixed frame and usually has at its free end a guide roller or the like which is moved along the upper horizontal beam when the door is opened or closed. The guide roller is preferably guided in an appropriate rail which is mounted on the crossbeam of the fixed frame.

An appropriate sliding element can also be used instead of the guide roller.

The horizontal movement of the guide roller or the like along the crossbeam of the fixed frame during opening of the door and the movement in the opposite direction during closing of the door can be utilized for controlling the closing sequence. If the moving wing is to be opened first and the resting wing is to be opened next, the moving wing can be easily opened and closed in the known manner even when the control arrangement is present. However, when the resting wing is opened with the moving wing being open or at least partially open, wherein the moving wing must be at least opened to such an extent that projecting edges of the two wings can be moved past each other, the opening of the resting wing results in a corresponding sliding movement of the guide roller of its door-closing device toward the axis of rotation of the resting wing. Of course, the guide roller of the moving wing travels toward the axis of rotation of the moving wing when the moving wing is opened.

When the resting wing is opened, the guide roller of the resting wing causes an adjusting movement of the locking member from the ineffective position into a locking position. The locking position is determined such that, when the moving wing is closed prior to the closing or at least prior to the complete closing of the resting wing, the moving wing is held in an open position which makes possible the complete closing of the resting wing without interference by the projecting edges of the wings. When the resting wing is closed, the guide roller of its door-closing device also assumes the initial position. At the end of the return movement of the guide roller, the guide roller moves the locking piece against the resistance of its spring in unlocking direction. This results in a release of the sliding member which can return into its initial position because of the restoring spring acting on it. The return movement of the sliding member automatically causes the turn of the locking member into its ineffective position. As a result, the obstacle for the guide roller of the door-closing device on the moving wing is removed and this door-closing device can now completely close the moving wing.

When the resting wing is improperly opened before the moving wing, this also leads to a corresponding sliding movement of the sliding member in the above-described manner and the attendant movement of the locking member in the direction towards its locking position. In this position, the locking member acts on the guide roller of the door-closing device of the moving wing and causes by means of the latter and the corresponding sliding arm an opening of the moving wing. Since the locking device on the resting wing has in the meantime started to operate, the locking member remains in its locking position until the entire arrangement begins to operate in the described manner by means of the closing end movement of the resting wing.

The arrangement according to the present invention has the advantage that it operates entirely mechanically. As a result, the arrangement is substantially more robust than an arrangement operating hydraulically. The assembly of the arrangement is simpler because no hydraulic lines are required. Thus, the arrangement is also less expensive.

The locking device composed of the locking element of the sliding member and of the locking piece which is fixed to the blind frame but spring-biased and slidable locks the return movement of the sliding member until it is released, so that it forms a locking and locating device. The control lever may be mounted directly or indirectly in the sliding member. The control lever is spring-biased toward the guide roller. Accordingly, when the control lever is pivoted by the guide roller, the spring acting on the lever is tensioned or its tension is increased. The locking member and locking element are coupled and operationally connected through the sliding member in such a way that the pivoting movement of the control lever into a released position for the guide roller resting against it is released only when the locking member is in its locking position, since a release of the guide roller on the resting wing by the control lever causes the displaced sliding member to be prevented in its return movement by the locking device. As a result, the correct closing sequence of the two wings is ensured even when the resting wing is further opened during which opening the guide roller is moved away from the control lever.

As soon as the guide roller is released from the control lever, the resting wing can be opened further, can be fixed in the open position and can again be closed when necessary or desired.

In accordance with the present invention, the spring-biased locking piece is held particularly by means of the guide roller in an ineffective position when the resting wing guide roller is in its initial position. In this situation, the spring acts on the locking piece. As soon as the controller releases the locking piece, which may occur already after a short opening movement of the resting wing, the spring presses the locking piece against the locking element which results in the locking action. The locking element preferably is constructed in such a way that locking in several locking positions of the sliding member is possible.

The second embodiment of the present invention relates particularly to a closing device which is mounted at the floor. When the wing to which the door-closing device is attached is swung, an element of the door-closing device is displaced along a straight line; the element may particularly be a damping piston with which such door-closing devices are equipped. The movement of the piston can be conducted, for example, through a lateral arm to a position of the housing at which the elements of the arrangement of the present invention required for the control of the closing sequence of the two wings can be accommodated. The lateral arm may support the above-described roller, a pin or a similar component. When this roller or the like carries out during opening and closing of the door a movement which corresponds to the movement of the resting wing guide roller or of the moving wing guide roller, it is readily apparent that the elements of this roller can be arranged exactly in the same manner as is the case in the illustrated embodiment of the moving wing guide roller 14 and the resting wing guide roller 15. Consequently, the movements and control operations are carried out in the same manner as in the first embodiment. Of course, in the case of a door-closing device mounted at the floor, the sliding member is also mounted at the floor and it must be appropriately protected and securely mounted in the floor.

The various features of novelty which characterize the invention are pointed out with particularity in the claims annexed to and forming a part of this disclosure. For a better understanding of the invention, its operating advantages and specific objects attained by its use, reference should be had to the drawing and descriptive matter in which there is illustrated and described a preferred embodiment of the invention.

DESCRIPTION OF THE PREFERRED EMBODIMENT

Figure 1:
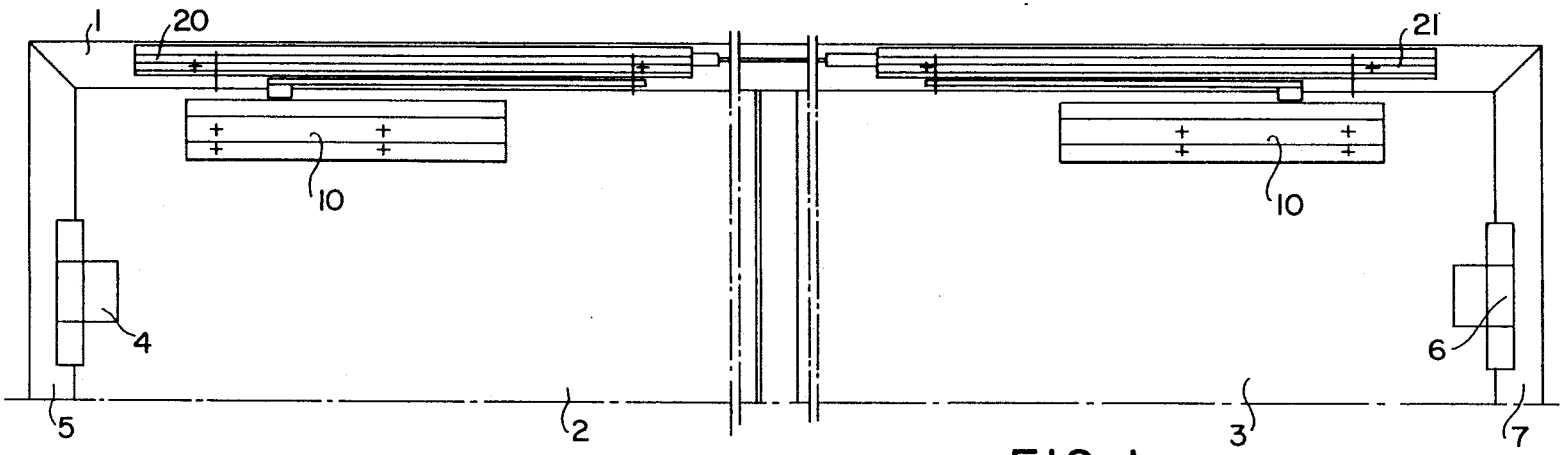
FIG. 1 is a schematic view of the upper ends of two closed door wings in a fixed frame with the arrangement according to the present invention for controlling the closing sequence of the doors.

As shown in FIG. 1 of the drawing, two doors are hinged to a fixed frame 1. Usually only the left door is opened and, for this reason, is called the moving wing 2. Because the right wing remains usually closed, it is called the resting wing 3. The moving wing 2 is attached by means of at least two hinges 4 arranged one above the other on the left vertical beam of the fixed frame 1, while the resting wing 3 is attached by means of hinges 6 to the right vertical beam 7 of the fixed frame 1. The two wings have at least at their free vertical sides a projecting edge 8 and 9, respectively. When the wings are closed, the projecting edges rest against each other. As can be easily seen from FIG. 2, the resting wing 3 cannot be completely closed when the moving wing 2 is closed too far or already completely closed. For this reason, the arrangement described below ensures that the resting wing 3 is always closed before the moving wing 2.

The moving wing 2 is closed by means of a door-closing device 10 of known construction. A door-closing device 11 of preferably the same construction is used for closing the resting wing 3. In the illustrated embodiment, door-closing devices mounted at the top of the doors are used. These door-closing devices are constructed as so-called sliding arm door-closing devices. However, the present invention cannot only be used in door-closing devices of this type, but they may rather also be used as door-closing devices at the bottom of the door.

Figure 2:
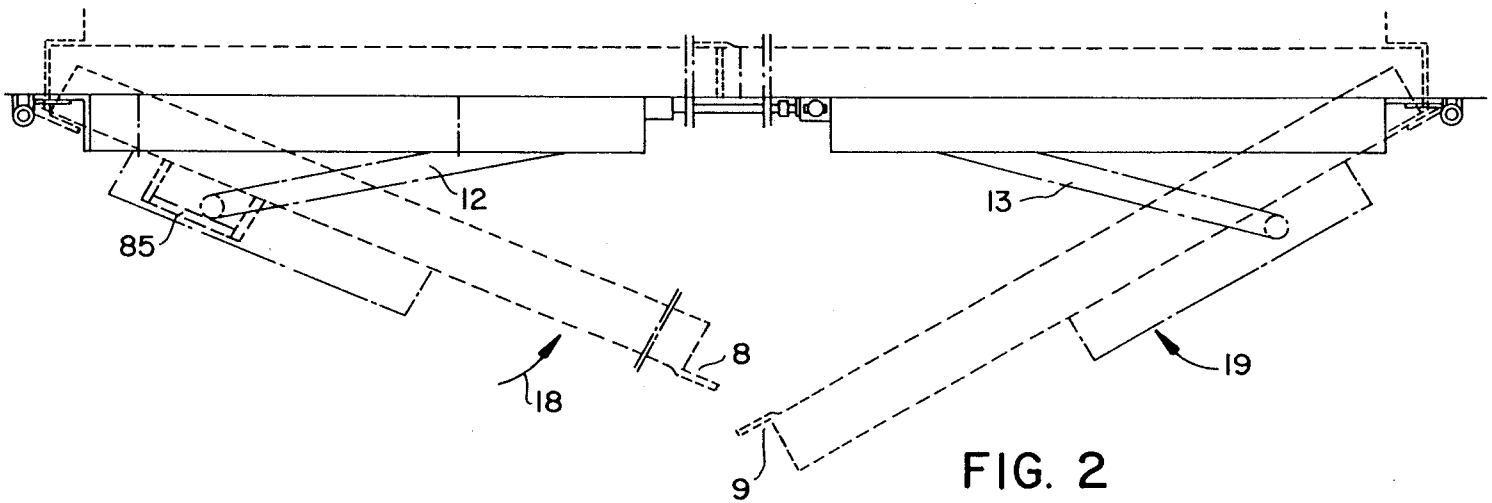
FIG. 2 is a top view of the wings of FIG. 1, the closed position of wings being indicated by solid lines and the open position by broken lines.
Figure 10:
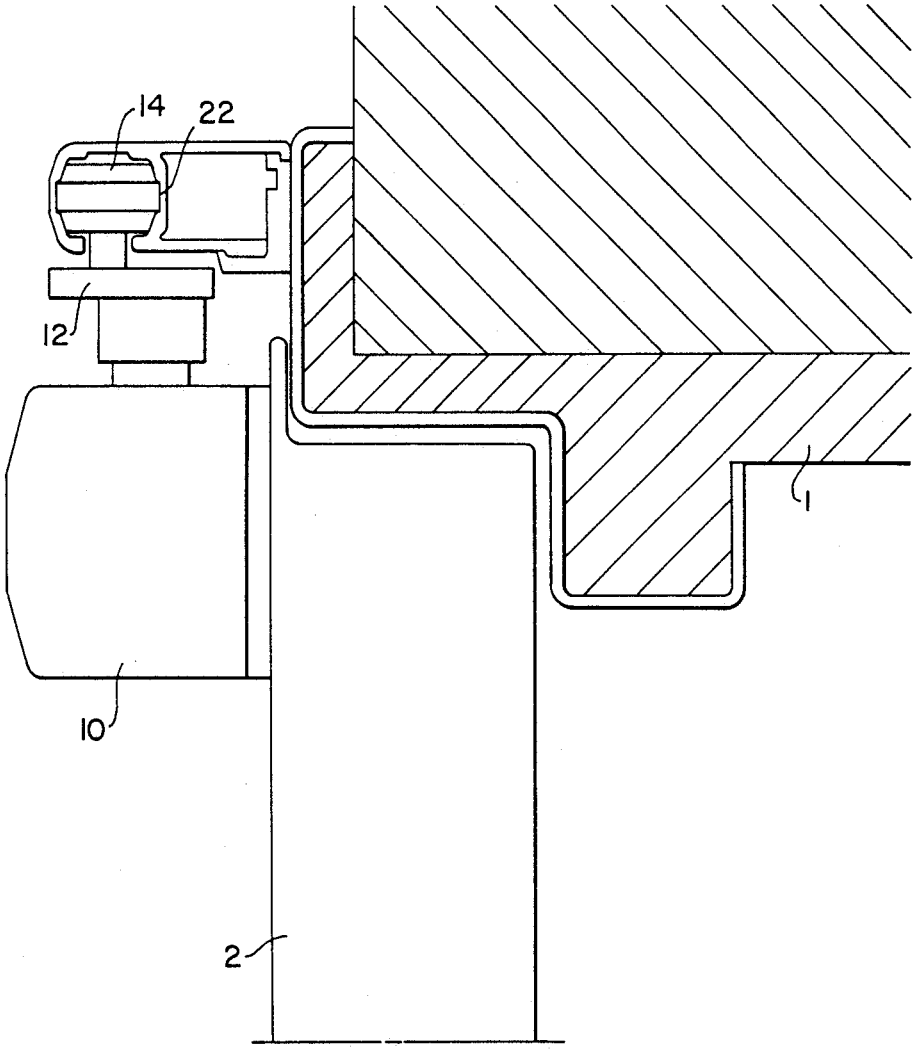
FIG. 10 is a vertical sectional view of the upper wing end and the fixed frame in the region of a door-closing device.

As illustrated in FIG. 2 in broken lines, sliding arm door-closing devices are attached to the door 2 or 3 and they each have a sliding arm 12 or 13. Each sliding arm has at its free end a sliding roller 14 or 15 or the like which can also be seen particularly well in FIG. 10 and in FIG. 3. Each door-closing device may also include a displaceable element, for example, a hydraulic piston 85, schematically illustrated in FIG. 2. While the sliding arm has a position when the door is closed which is approximately parallel or slightly inclined to the plane of the door, the sliding arm is pivoted relative to the plane of the door when the door is opened. As a result, the sliding roller is moved toward the hinge side of the door. Thus, when the wing 2 is opened, the sliding roller is moved parallel to the transverse beam of the fixed frame in the direction of arrow 16, while the sliding roller 15 of the resting wing 3 is moved in the direction of arrow 17.

The partially or completely opened door can be fixed or locked in its position in an open manner, by means of a locking device integrated in the door-closing device. When the partially or completely open door is released, the door is closed in the direction of arrow 18 in the case of moving wing 2 and in the direction of arrow 19 in the case of resting wing 3. If, as shown in FIG. 2, the resting wing 3 is opened farther than the moving wing 2, the closing movement of the wing 2 ends by means of the arrangement according to the present invention when the position illustrated in FIG. 2 is reached. In this position, the projecting edge 9 of the resting wing 3 can still be moved past the projecting edge 8.

The sliding rollers 14 and 15 are usually guided during opening and closing of the wings in a guide rail 20 or 21 which, when the door-closing device is mounted at the top of the door, is attached to the upper transverse beam of the fixed frame 1, usually by being placed on the frame. The guide rails are divided into two chambers 23 and 24 by means of a central wall 22. The outer chamber 24 forms the longitudinal guidance for the slide roller 14 or 15. The inner chamber 23 serves to accommodate the essential elements of the arrangement for controlling the closing sequence.

The essential elements of the arrangement for controlling the closing sequence of the two wings 2 and 3 are a locking member 25, a sliding member 26 and a locking device 27. A control lever 28 is another important element.

Figure 3:
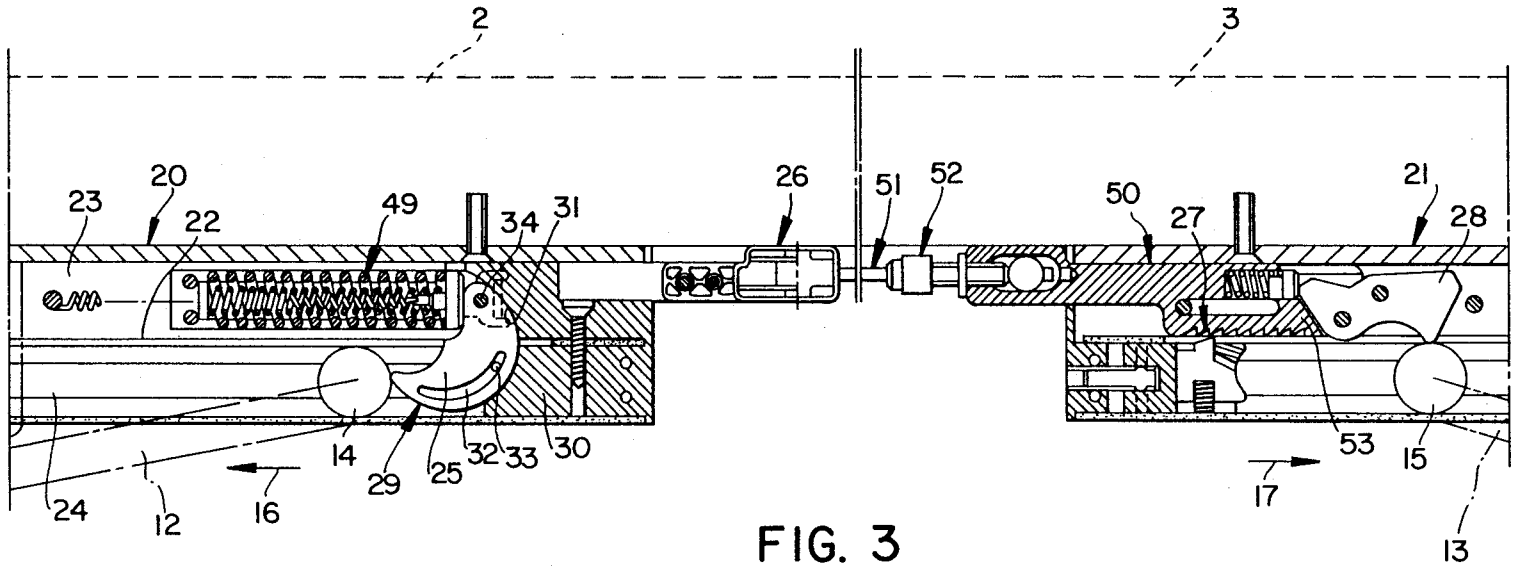
FIG. 3 is a partial view of the arrangement on a larger scale, partially in horizontal direction.
Figure 4:
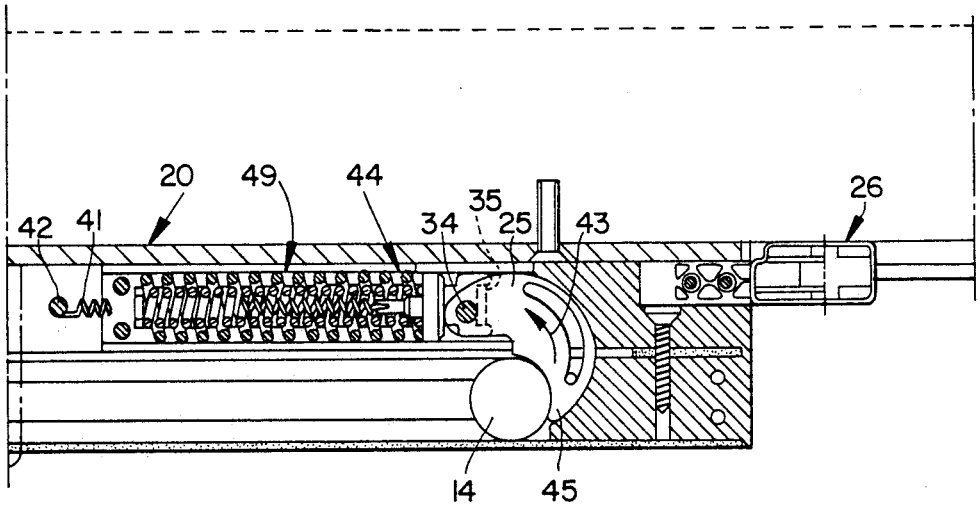
FIG. 4 on an even larger scale, a portion of the left half of FIG. 1 with closed wing.
Figure 8:
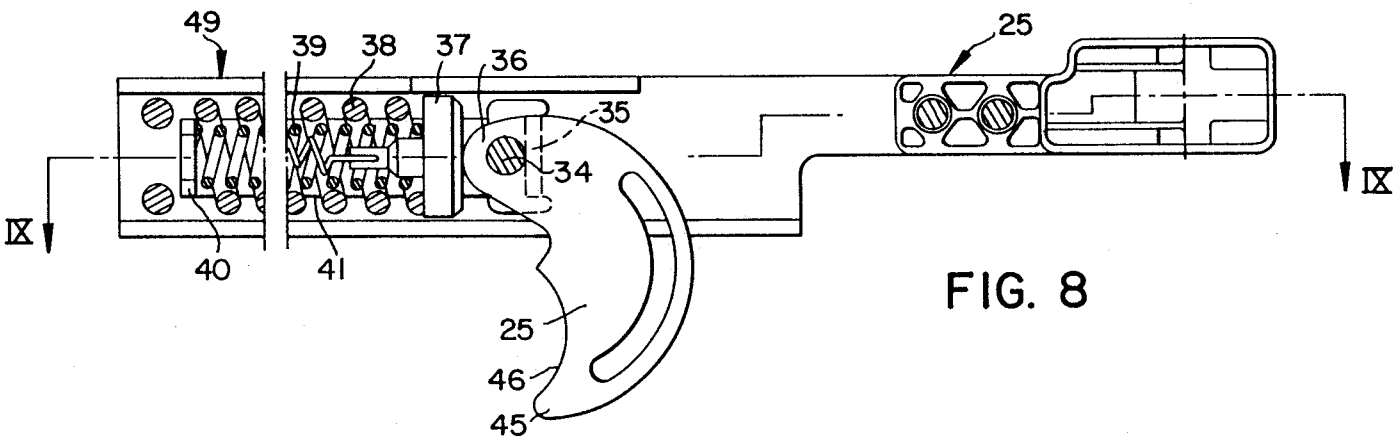
FIG. 8 shows, on an even larger scale, a structural component of FIG. 1.
Figure 9:
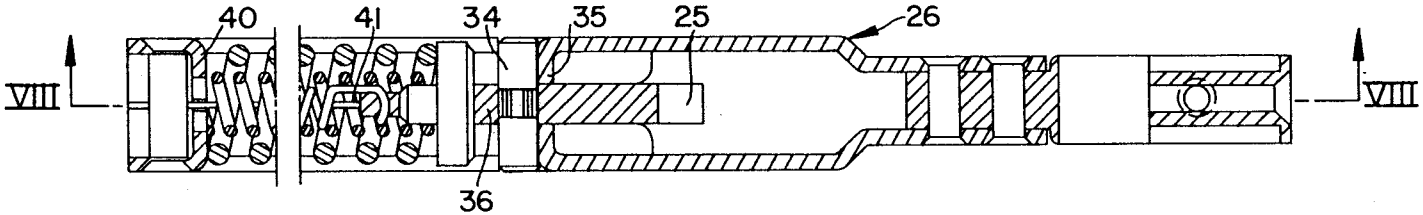
FIG. 9 is a sectional view along sectional line IX—IX of FIG. 8.

The locking member 25 has a circular arc-shaped back side 29 which rests against a receiving portion of a guide member 30 having the same shape, for example, having the shape of a slot. The guide member 30 is fastened to the guide rail 20 at the left end thereof, as can be seen in FIG. 3. Thus, the back side 29 slides on the circular arc-shaped support surface 31 of the guide member 30. Thus, the locking member is a rotating member whose rotating movement is limited by a circular arc-shaped guide slot 32 of the locking member 35 and a guide bolt 33 engaging in the slot 32. The guide bolt 33 is held in the guide member 30. The locking member 25 has at its upper end as seen in FIG. 3 a driving bolt 34 which extends transversely of the plane of the locking member 25 and projects on both sides thereof. In the position of rotation of the locking member 25 shown in FIG. 8, the driving bolt 34 rests against a wall 35 of the sliding member 26 which wall 35 extends transversely of the plane of the Figure. An arched end 36 of the locking member 25 rests in the region of the driving bolt 34 against a pressure piece 37 against which, in turn, rest two concentrically arranged springs 38 and 39. The springs are helical compression springs. The left end of the springs as seen in FIG. 9 rest indirectly against the sliding member 26 through a bracing member 14. A rotation of the locking member 25 from the locking position shown in FIG. 5 to the initial position shown in FIG. 4 results in a tensioning of the springs 38 and 29. A third spring is attached at the inner end of the pressure piece 37. This third spring forms a restoring spring 41 for the sliding member 26. The right end of the restoring spring 41 visible in FIG. 4 is attached to a bolt 42 of the guide rail 20. When the restoring spring 41 pulls the sliding member 26 which is in the right position in FIG. 5 back into the initial position shown in FIG. 4, the wall 35 presses against the driving bolt 34 and thereby causes a return rotation of the locking member 25 in the direction of arrow 43. A damping device 44 is formed by the springs 38 and 39 with the pressure piece 37.

Figure 5:
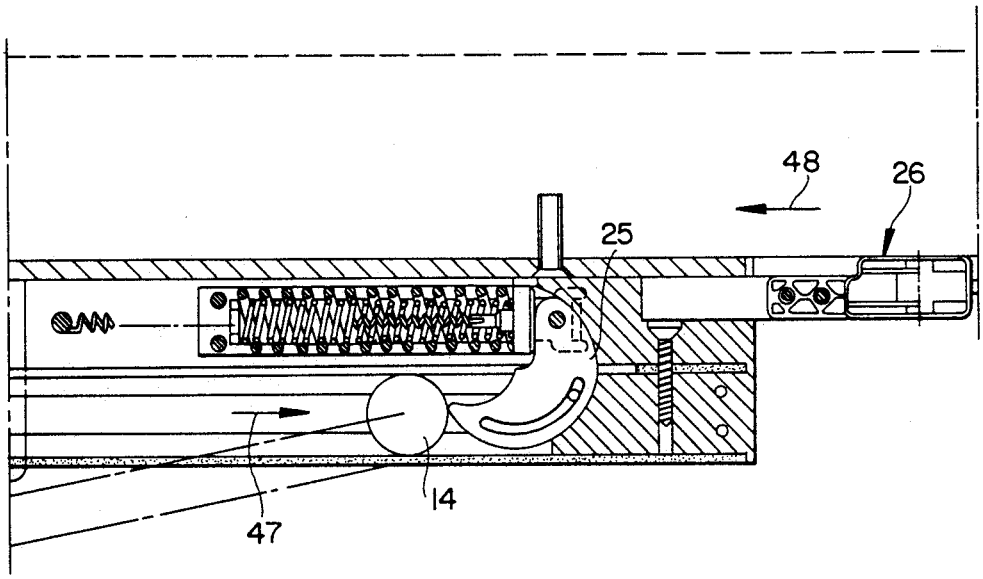
FIG. 5 is a corresponding view with the left wing partially open.

The lower end 45 of the approximately sickle-shaped locking member 25 as seen in FIG. 4 surrounds with a circular arc-shaped edge 46 the sliding roller 14 of the door-closing device 10. When the door is opened, the sliding roller 14 moves out of the edge 46. When the locking member 25 is in the locking position as seen in FIG. 5, the sliding roller 14 arising in the direction of arrow 47 can only be moved until it makes contact with the lower end 45. Any impact occurring during this closing procedure of the moving wing is absorbed by the damping device 44.

However, the sliding roller 14 can rotate the locking device 25 in the direction of arrow 43 when the sliding member 26 is released for displacement in the direction of arrow 48. This return movement of the sliding movement 36 is locked by the locking device 27 seen in FIG. 3 until the resting wing 3 is closed.

The sliding member 26 is composed at least essentially of two sliding member parts 59 and 50 which are arranged in axial alignment with each other and which are coupled through a preferably longitudinally adjustable intermediate member 51. Into the illustrated embodiment, the sliding member part 49 is arranged in the guide rail 20 and the sliding member part 50 in the guide rail 21. Each of these two sliding member parts may include additional components, however, these are not of significance. The intermediate member may be a cable, a connecting rod or the like.

Figure 6:
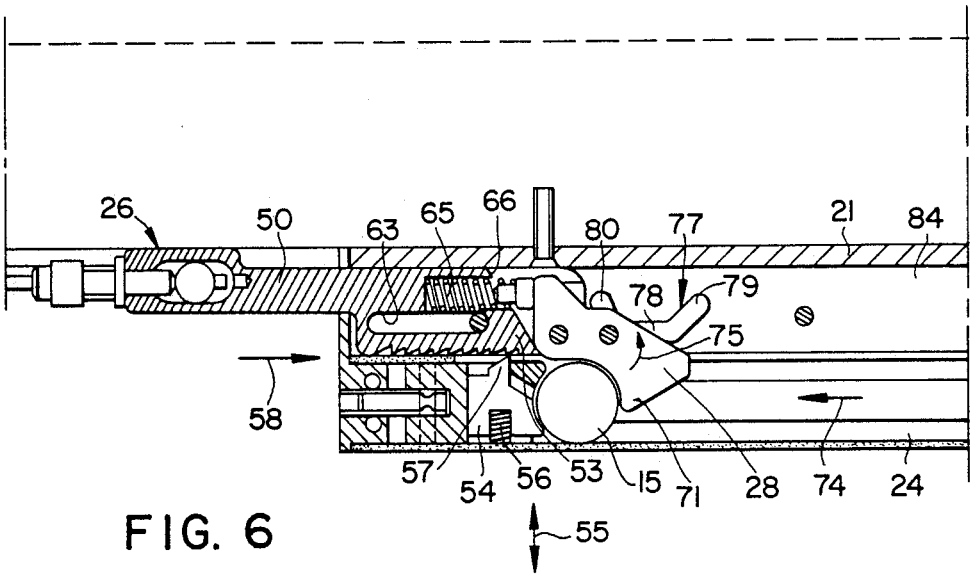
FIG. 6 a corresponding illustration of the right portion of FIG. 3 with the wing being closed.

To be able to exactly adjust the distance between the two sliding member parts 49 and 50, a longitudinal adjusting device 52 is arranged, for example, on the intermediate member 51. The longitudinal adjusting device 51 may be of known construction, for example, as shown in FIG. 3. The sliding member part 50 of the resting wing includes a locking element 53 of the locking device 27. As illustrated, for example, in FIG. 6, the locking element 53 is integrally connected to sliding member part 50. The locking element 53 advantageously has the shape of a rack with sawtooth-like toothing. The locking element 53 interacts with a spring-biased locking piece 54 which is slidable in the direction of double arrow 55 transversely of the longitudinal axis of the outer chamber 24 of the guide rail 21 in which the locking element 53 is mounted. The spring for biasing the locking piece 54 is denoted by reference 56. The locking piece 54 has a tooth 57 which can enter into the tooth gaps of the locking element 53. However, as shown in FIG. 6, the tooth 57 does not engage the tooth gaps of the locking element 53 because the sliding roller 15 prevents it from doing so. However, once tooth 57 engages the locking element 53, the sliding member part 50 can be moved in the direction of arrow 58 but cannot be moved back in the opposite direction. A sliding movement of the sliding member part 50 and, thus, of the entire sliding member 26 against the direction of arrow 58 is only possible when the tooth 57 has previously been disengaged from the toothing of the locking element 53. To be able to adjust the tooth 57 relative to the locking element 53 in longitudinal direction, the locking piece 54 is slidably mounted on an adjusting member 59 which can be adjusted relative to the end piece 61 by means of a control member 60 which is composed of a threaded spindle. The control member 60 is rotatably but non-slidably mounted in the adjusting member 59 and can be screwed into a thread 62 of the end piece 61.

For guiding the sliding member part 50 in the inner chamber 23 of the guide rail 21, the sliding member part 50 has a longitudinal slot 63 which is engaged by a guide bolt 64 and extends in longitudinal direction of the guide rail 21. Parallel to the longitudinal slot 63 is provided a receiving means 65 for a compression spring 66 which is constructed as a helical spring. The left end of the spring rests against a blind end 4 of the receiving means 65 while the right end of the spring rests against a first level arm 68 of the control lever 28, particularly with the intermediate arrangement of a pressure member 67.

The control lever 28 is rotatably mounted on the sliding member part 50 by means of a bearing axis 69. The bearing axis is preferably located at the free end of the sliding member part 50 in the region of the right end of the locking element.

The compression spring 66 holds the control lever 28 in the position shown in FIG. 6 when the resting wing is closed. In this position, the arc-shape edge 70 of the control lever 28 surrounds the sliding roller 15. The control lever 28 further has a wedge-shaped projection 71 forming an outer inclined contact surface 72 and an inner inclined pressure surface 73. As is easily apparent, the sliding roller 15 which is located to the right of the wedge-shaped projection 71 when the resting wing is open can pivot the control lever 28 through the inclined contact surface 72 against the resistance of the compression spring 66 in the direction of arrow 75. In the same manner, in case of a sliding movement directed against the direction of arrow 74, the sliding roller 15 can also pivot the control lever 28 in the direction of arrow 75 by means of the inclined pressure surface 73.

A particularly bolt-shaped guide element 76 is mounted on the control lever 28. The guide element 76 extends parallel to the control lever 28 and is mounted laterally spaced from the bearing axis 29. The guide element 76 engages in a guide slot 77 which may be located in a plane below or above the pivoting plane of the control lever 28. In the illustrated embodiment, this guide slot is provided in the guide rail 21, particularly in the bottom of the inner chamber 23. The guide slot includes a middle portion 78 which extends straight, i.e., parallel to the longitudinal axis of the guide rail and two diverging guide portions 79 and 80 which are inclined relative to the middle portion 78 and are directed towards the fixed frame 1, as can be seen in FIG. 6. As a result, the control lever 28 cannot be turned in the direction of arrow 75 when the guide element 76 is in the middle portion 78 of the guide slot. Thus, if an opening movement of the resting wing causes the slide roller 14 to be moved against the direction of arrow 74 in a manner to be described below, the control lever 28 remains in its initial position until the bolt-like guide element 76 reaches the inclined side portion 76 which is directed inwardly and to the right. A pivoting movement in the direction of arrow 75 is subsequently possible and this means that the sliding roller 15 is released from the arc-shaped edge 70 and is moved along the wedge-shaped projection 71 of the control lever 28.

Figure 7:
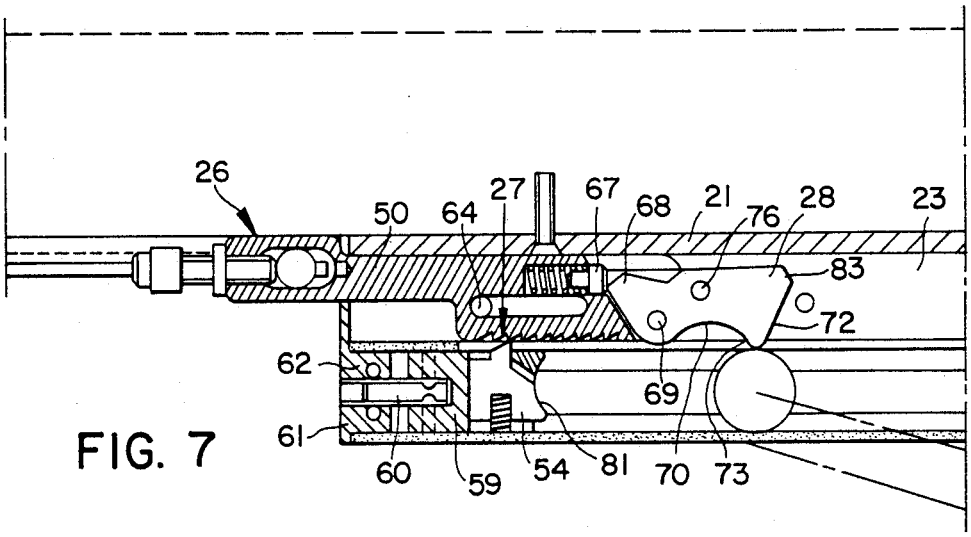
FIG. 7 a corresponding view with the right wing being partially open.

As FIG. 6 of the drawing shows, when the resting wing is closed, the guide element 76 is approximately at the transition of the side portion 80 in the middle portion 78 If, due to a manipulation of the device after releasing the locking device 27, the sliding member 26 is in its left initial position but the sliding roller 15 is to the right of the wedge-shaped projection 71, locking of the sliding roller 15 with the control lever 28 in the closing position of the resting wing is possible because the guide element 76 can move into the side portion 80. The spring 65 subsequently pivots the control lever 28 into the initial position shown in FIG. 6. It should be added that, during normal operation and with the resting wing 3 being opened, the control lever 28 maintains its upwardly pivoted position illustrated in FIG. 7. Accordingly, the sliding roller 15 interacts with the inclined contact surface 72 only when the device is manipulated or, to a limited extent, when due to tolerances the wedge-shaped projection 71 projects somewhat into the path of movement of the returning sliding roller 15.

When during closing of the resting wing the sliding roller 15 arrives at the locking piece 54, its shape in conjunction with a correspondingly extending inclined pressure surface 81 causes an unlocking movement of the locking piece 54 in the direction of arrow 82. Subsequently, the force of the restoring spring 41 which concentrically extends through the springs 38 and 39, become effective and, with the resting wing 3 now being closed, the restoring spring 41 can pull the sliding member 26 towards the left into the initial position, which also pivots the locking member 25 back into its initial position. This makes possible the final closing movement of the sliding roller 14 of the moving wing 2 which causes the latter also to be closed by means of a door-closing device. It should be added that the second lever arm of the control lever 28 which supports the guide element 76 is denoted by reference numeral 83.

From the above description of the individual components, the manner of operation of the arrangement of the invention is relatively easy to understand. When both wings are closed and the moving wing is to be opened, this can be done easily in the conventional manner because there is no obstacle to the necessary displacement movement of the sliding roller 14 of the door-closing device 10 of the moving wing, as is clear from FIG. 4. Consequently, the moving wing can also be easily closed.

If the resting wing is opened after the moving wing has previously opened, sliding roller 15 of the door-closing device 11 takes along the sliding member through the control lever 28 in the direction of arrow 58, as shown in FIG. 6. As soon as the sliding roller 15 has moved away from the locking piece 54 of the locking device 27 to a sufficient extent, the tooth 54 is engaged in the locking element 53. The latter and the sliding member 26 can still be moved further in the direction of arrow 58, but they cannot be moved back in the opposite direction. As a result, the locking member 25 which during the displacement of the sliding member 26 had been pivoted into a locking position remains in the locking position shown in FIG. 3. When the moving wing is closed before the resting wing, this is only possible until the sliding roller 14 makes contact with the locking member 25. The resulting inclined position of the moving wing 2 shown in FIG. 2 makes it possible to subsequently close the resting wing 3. When this occurs, the locking device 27 is released in the described manner and the locking member 25 is pivoted by the sliding member 26 from the final displacement range of the sliding roller 14, so that the door-closing device 10 can now close or finish closing the resting wing.

The components of the arrangement are mounted protected in the guide rails, so that they usually are not damaged and can also usually not be damaged intentionally or rendered inoperative. This also results, of course, in a positive aesthetic effect. As already mentioned, the arrangement operates safely even when it is unintentionally or intentionally incorrectly operated. When manipulations are carried out on the arrangement, the components can essentially not be damaged, so that the operation is always ensured.

When the locking device is released, the locking member 25 is returned to the initial position by means of spring 41, so that the force of the spring in the door-closing device is fully available for obtaining the final position of the moving wing. Thus, it is possible to overcome the forces which are necessary, for example, for operating a trap.

The release of the locking device is independent of the width of the door wings. It is merely necessary to adjust the length of the connection between the locking device and the locking member 25.

As already mentioned, the arrangement of the invention can also be used with door-closing devices which are mounted at the bottom of the door. In that case, the longitudinal movement in the system of the door-closing device, for example, in the damping piston, is utilized for the control. The locking device or the locking member 25 can be accommodated in the door-closing device.

It should be added with respect to the construction of the arrangement that the travel distance of the drive bolt 34 on the locking member 25 is smaller than the travel distance of the corresponding sliding roller 14. In addition, a separate insert 84 can be mounted in the inner chamber 23 of the guide rail 21 in which insert 84 is slidably mounted the sliding member part 50 on the side of the resting wing. In that case, the guide slot 77 is provided on this insert 84 or additionally on this insert.

When it is attempted to close the moving wing by applying force when the resting wing 3 is open, this force is absorbed by the damping device 44. Subsequently, the force of the spring again opens the moving wing to such an extent that the correct closing sequence is ensured.

While a specific embodiment of the invention has been shown and described in detail to illustrate the application of the inventive principles, it will be understood that the invention may be embodied otherwise without departing from such principles.

We claim:

1. In an arrangement for the control of the closing sequence of two wings of windows, doors or the like which are closable by means of a door-closing device each, the two wings being a moving wing to be opened first and a resting wing to be opened subsequently, each door-closing device attached to a wing being equipped with a guide roller which is mounted on a pivotable sliding arm and is horizontally guided on a fixed frame, the improvement comprising a locking member which is movable by an opening movement of the resting wing into a return end region of the moving wing guide roller, the locking member being movable parallel to the wing plane by means of a sliding member which is adjustable horizontally and parallel to the plane of the fixed frame, the sliding member being provided with a locking element of a locking device, the locking element being slidable against the force of a restoring spring by the opening movement of the resting wing guide roller, a spring-biased control lever supported on the sliding member being arranged between the locking element and the resting wing guide roller, wherein the control lever projects into an initial displacement region of the resting wing guide roller, means for releasing the pivoting movement of the control lever only in the locking position of the locking member, the locking device including a spring-biased locking piece, means for holding the spring-biased locking piece of the locking device in an ineffective position in the initial position of the resting wing guide roller, wherein the locking piece is disengaged by a return end movement of the roller.

2. The arrangement according to claim 1, wherein the control lever surrounds the guide roller of the resting wing with a wedge-shaped projection, the projection having first and second wedge sides, the first wedge side forming an inclined contact surface for the guide roller and the second wedge surface forming an inclined pressure surface for the guide roller.

3. The arrangement of claim 1, wherein the locking member is a rotary slide-like pressure element mounted on the sliding member.

4. The arrangement according to claim 3, wherein the locking member is guided in a turning direction by means of a circular arc-shaped guide slot and a guide bolt engaging the guide slot.

5. The arrangement according to claim 4, wherein the guide slot is provided in the locking member, the locking member having a rear surface which extends concentrically with the guide slot, the rear surface of the locking member resting against a correspondingly concave support surface of a guide member mounted on the guide rail.

6. The arrangement according to claim 3, wherein the locking member is approximately sickle-shaped, the locking member having an end facing away from the guide roller of the moving wing, the end of the locking member supporting a driving bolt extending transversely of the turning plane of the locking member, the sliding member having a wall which can be at least brought into contact with the driving bolt, the driving bolt being located between the sliding member and a damping device at the end of the locking member.

7. The arrangement according to claim 6, wherein the damping device has at least one concentric helical compression spring.

8. The arrangement according to claim 6, wherein the damping device has two concentric helical compression springs.

9. The arrangement according to claim 8, wherein an end of the restoring spring is connected to a pressure piece arranged between the helical compression springs and the locking member, another end of the restoring spring being fastened to one of the guide rails or the fixed frame.

10. The arrangement according to claim 3, wherein the guide rollers of the door-closing devices are supported in a first longitudinal guide means of at least one guide rail fastened to the fixed frame, and wherein the sliding member is mounted in a second longitudinal guide means of the at least one guide rail extending parallel to the first longitudinal guide means, and wherein the second longitudinal guide means is located between the first longitudinal guide means and an adjacently mounted transverse beam of a blind frame.

11. The arrangement according to claim 10 wherein the sliding member has two sliding member portions which are arranged in axial alignment with each other and are mounted separately each in the guide rails, the sliding member portions being coupled by means of a longitudinally adjustable intermediate member.

12. The arrangement according to claim 11, wherein the sliding member portion of the resting wing is guided on the guide rail by means of a pin and oblong hole connection in the longitudinal direction of the guide rail.

13. The arrangement according to claim 11 wherein the locking element is connected to the sliding member portion on the resting wing.

14. The arrangement according to claim 13, wherein the locking element comprises a rack with sawtooth-like toothing and wherein the locking piece has a tooth with a shape which corresponds to the shape of the toothing of the rack.

15. The arrangement according to claim 11, wherein the control lever is pivotably mounted on the sliding member portion of the resting wing.

16. The arrangement according to claim 15, wherein the control lever has first and second arms, the first lever arms being supported on a compression spring resting against the sliding member and the second lever arm resting against the guide rollers of the door-closing device of the resting wing when the resting wing is closed.

17. The arrangement according to claim 16, wherein the guide roller of the resting wing is between the second lever arm of the control lever and the locking piece of the locking device when the resting wing is closed.

18. The arrangement according to claim 17, the control lever having a wing axis, a bolt-shaped guide element being provided on the second lever arm of the control lever spaced from the bearing axis thereof, the bolt-shaped guide element engaging in a guide slot of the guide rail, the guide slot having a middle portion extending approximately parallel to the plane of the frame and two side portions which diverge toward the frame and extend obliquely relative to the middle portion.

19. The arrangement according to claim 18, wherein the spring-biased locking piece is mounted on an adjusting member extending parallel to the plane of the frame and mounted on the guide rail, the adjusting member being adjustable by means of a threaded spindle.

20. The arrangement according to claim 19, wherein the locking piece has an inclined pressure surface, the inclined pressure surface resting against the guide roller when the resting wing is closed.

21. In an arrangement for the control of the closing sequence of two wings of windows, doors or the like which are closable by means of a door-closing device each, the two wings being a moving wing to be opened first and a resting wing to be opened subsequently, each door-closing device being connected to a fixed frame and having an element which is displaceable by the swinging movement of the door, the improvement comprising a locking member which is movable by a roller of the moving wing which is fixedly connected to the displaceable element, the locking member being movable parallel to the wing plane by means of a sliding member which is adjustable horizontally and parallel to the plane of the fixed frame, the sliding member being provided with a locking element of a locking device, the locking element being slidable against the force of a restoring spring by the opening movement of the roller of the resting wing, a spring-biased control lever supported on the sliding member being arranged between the locking element and the roller of the resting wing, wherein the control lever projects into an initial displacement region of the roller of the resting wing, means for releasing the pivoting movement of the control lever only in the locking position of the locking member, the locking device including a spring-biased locking piece, means for holding the spring-biased locking piece of the locking device in an ineffective position in the initial position of the roller of the resting wing, wherein the locking piece is disengaged by a return end movement of the roller.

22. The arrangement according to claim 21, wherein the control lever surrounds the roller of the resting wing with a wedge-shaped projection, the projection having first and second wedge sides, the first wedge side forming an inclined contact surface for the roller and the second wedge surface forming an inclined pressure surface for the guide roller.

23. The arrangement according to claim 21, wherein the displaceable element is a hydraulic piston.

24. The arrangement of claim 21, wherein the locking member is a rotary slide-like pressure element mounted on the sliding member.

25. The arrangement according to claim 24, wherein the locking member is guided in a turning direction by means of a circular arc-shaped guide slot and a guide bolt engaging the guide slot.

26. The arrangement according to claim 25, wherein the guide slot is provided in the locking member, the locking member having a rear surface which extends concentrically with the guide slot, the rear surface of the locking member resting against a correspondingly concave support surface of a guide member mounted on the guide rail.

27. The arrangement according to claim 24, wherein the locking member is approximately sickle-shaped, the locking member having an end facing away from the guide roller of the moving wing, the end of the locking member supporting a driving bolt extending transversely of the turning plane of the locking member, the sliding member having a wall which can be at least brought into contact with the driving bolt, the driving bolt being located between the sliding member and a damping device at the end of the locking member.

28. The arrangement according to claim 27, wherein the damping device has at least one concentric helical compression spring.

29. The arrangement according to claim 27, wherein the damping device has two concentric helical compression springs.

30. The arrangement according to claim 29, wherein an end of the restoring spring is connected to a pressure piece arranged between the helical compression springs and the locking member, another end of the restoring spring being fastened to one of the guide rails or the fixed frame.

31. The arrangement according to claim 24, wherein the rollers of the door-closing devices are supported in a first longitudinal guide means of at least one guide rail fastened to the fixed frame, and wherein the sliding member is mounted in a second longitudinal guide means of the at least one guide rail extending parallel to the first longitudinal guide means, and wherein the second longitudinal guide means is located between the first longitudinal guide means and an adjacently mounted transverse beam of a blind frame.

32. The arrangement according to claim 31, wherein the sliding member has two sliding member portions which are arranged in axial alignment with each other and are mounted separately each in the guide rails, the sliding member portions being coupled by means of a longitudinally adjustable intermediate member.

33. The arrangement according to claim 32, wherein the sliding member portion of the resting wing is guided on the guide rail by means of a pin and oblong hole connection in the longitudinal direction of the guide rail.

34. The arrangement according to claim 32, wherein the locking element is connected to the sliding member portion on the resting wing.

35. The arrangement according to claim 34, wherein the locking element comprises a rack with sawtooth-like toothing and wherein the locking piece has a tooth with a shape which corresponds to the shape of the toothing of the rack.

36. The arrangement according to claim 32, wherein the control lever is pivotably mounted on the sliding member portion of the resting wing.

37. The arrangement according to claim 36, wherein the control lever has first and second arms, the first lever arms being supported on a compression spring resting against the sliding member and the second lever arm resting against the rollers of the door-closing device of the resting wing when the resting wing is closed.

38. The arrangement according to claim 37, wherein the roller of the resting wing is between the second lever arm of the control lever and the locking piece of the locking device when the resting wing is closed.

39. The arrangement according to claim 38, the control lever having a wing axis, a bolt-shaped guide element being provided on the second lever arm of the control lever spaced from the bearing axis thereof, the bolt-shaped guide element engaging in a guide slot of the guide rail, the guide slot having a middle portion extending approximately parallel to the plane of the frame and two side portions which diverge toward the frame and extend obliquely relative to the middle portion.

40. The arrangement according to claim 39, wherein the spring-biased locking piece is mounted on an adjusting member extending parallel to the plane of the frame and mounted on the guide rail, the adjusting member being adjustable by means of a threaded spindle.

41. The arrangement according to claim 49, wherein the locking piece has an inclined pressure surface, the inclined pressure surface resting against the roller when the resting wing is closed.

* * * * *